United States Patent [19]

Ono et al.

[11] 4,400,462

[45] Aug. 23, 1983

[54] METHOD FOR THE FORMATION OF PHOTOGRAPHIC IMAGES

[75] Inventors: Kouzi Ono; Mikio Kawasaki; Mariko Natori; Eiichi Sakamoto, all of Hino, Japan

[73] Assignee: Konishiroku Photo Industry Co., Ltd., Tokyo, Japan

[21] Appl. No.: 268,776

[22] Filed: Jun. 1, 1981

[30] Foreign Application Priority Data

Jun. 11, 1980 [JP] Japan ..... 55-79379

[51] Int. Cl.[3] ..... G03C 5/24

[52] U.S. Cl. ..... 430/415; 430/416; 430/523; 430/524; 430/231; 430/229; 430/234; 430/247; 430/246

[58] Field of Search ..... 430/234, 415, 416, 231, 430/229, 247, 523, 524, 246

[56] References Cited

U.S. PATENT DOCUMENTS

| | | | |
|---|---|---|---|
| 3,206,313 | 9/1965 | Porter et al. | 430/599 |
| 3,647,439 | 3/1972 | Bass | 430/416 |
| 4,288,522 | 9/1981 | Carael et al. | 430/231 |
| 4,299,908 | 11/1981 | Ito et al. | 430/234 |

FOREIGN PATENT DOCUMENTS 54-48544 4/1979 Japan .

*Primary Examiner*—Won H. Louie, Jr.

*Attorney, Agent, or Firm*—Jordan B. Bierman; Linda Bierman

[57] ABSTRACT

Photographic materials and photographic processes employing light sensitive silver halide particles, silver halide particles which are substantially non-light sensitive having been modified with a silver halide solubility reducing agent and internally fogged silver halide particles which are substantially non-light sensitive provide negative silver images of high contrast and high maximum density.

10 Claims, 1 Drawing Figure

METHOD FOR THE FORMATION OF PHOTOGRAPHIC IMAGES

The present invention relates to a novel method for the formation of photographic images, and more particularly to a method for the formation of photographic negative images having a high contrast and a high maximum density with the use of a silver halide photographic light-sensitive material having layers containing a light-sensitive silver halide and silver halide having a metallic salt and fogging nucleus respectively.

The supply of silver which is essential as the principal material for silver halide photographic light-sensitive materials is now getting declined whereas the price of silver is being drastically fluctuated because of its increasing demands from various industries. The photographic industry, in order to cope with such situation, is actively at grips with the problem of how to practice economy in the use of silver.

A typical example for economizing the use of silver is the silver diffusion transfer process which utilizes physical development nuclei. This process is known as a very useful image forming method for the reason that it not only has a very high covering power to transferred images, so that it enables the use of a small amount of silver to give high density photographic images but is excellent in the speed and sharpness.

However, the above is for the production of negative-positive type diffusion transfer process to give finally a positive image, so that it is not suitable for the method and object of the present invention.

On the other hand, Japanese Patent Publication Open to Public Inspection (hereinafter referred to as Japanese Patent O.P.I. Publication) No. 48544/1979 proposes such a composition of a light sensitive material for obtaining a negative image in the final form as having a support coated thereon with (1) a layer containing a light-sensitive silver halide, (2) a layer containing well-soluble metallic salt particles to which is adsorbed a less-solubilizing agent, and (3) a layer containing physical development nuclei.

However, this method has such drawbacks that besides being prone to produce fog and such stain as resulting from physical development nuclei, it tends to make the color tone of the developed silver in the less exposed region sepia.

The principal object of the present invention is to provide a novel method for the formation of photographic negative images free of fog and stain.

The second object of the present invention is to provide a method for the formation of high contrast photographic negative images wherein the color tone of the developed silver in the less exposed region is pure black.

To achieve the above objects, we have devoted ourselves to work and as a result we have found that these objects are attainable by processing an imagewise exposed silver halide photographic light-sensitive material, which comprises a support and a photographic element coated on said support, said photographic element comprising (1) light-sensitive silver halide particles, (2) substantially non-light-sensitive and less-soluble metallic salt particles of metallic salt which the metallic salt is itself soluble in a processing solution as defined hereinafter but the surface thereof is made less-soluble in said processing solution by a compound which makes the metallic salt particles less soluble and (3) internally fogged and substantially non-light-sensitive silver halide particles, with the processing solution containing at least a reducing agent and an agent for dissolving said metallic particles.

The method for the formation of photographic images of the present invention is such that the physical development nuclei conventionally used in a photosensitive material for obtaining a negative image in such a silver diffusion transfer process as described in the foregoing publication has been improved by converting into the method of the use of internally fogged and substantially non-light-sensitive silver halide particles in accordance with the present invention. The method for the formation of photographic images in the present invention, therefore, makes possible not only to give high-contrast negative images but to prevent the production of fog and stain and further to prevent the undesirable sepia toning of the developed silver in the less exposed region.

The following are detailed descriptions of the method for the formation of photographic images of the present invention.

Light-sensitive silver halides to be contained in the light-sensitive layer for use in the method for the formation of photographic images of the present invention include silver chloride, silver bromide, silver iodide, silver chlorobromide, silver iodobromide, silver chloroiodobromide or mixtures of these silver halides. The use of high speed silver iodobromide is preferred. A silver iodobromide containing 50 mol % or less silver iodide is most suitably usable in the present invention.

Photographic emulsions containing the above-described silver halides may be prepared by various production methods including conventionally applied methods and such other methods as described in Japanese Patent Examined Publication No. 7772/1971 and U.S. Pat. No. 2,592,250, the latter describing the so-called "conversion" emulsion method such as, e.g., the single-jet emulsion method, double-jet emulsion method and the like.

Silver halide particles for use in the present invention include those having various crystal habits.

These silver halide emulsions are chemically sensitizable by the use of various chemical sensitizers which include such known sensitizers as sulphur sensitizers, selenium sensitizers, noble metal sensitizers and the like, reducing sensitizers and polyalkylene oxide sensitizers and the like.

Further, the foregoing silver halide emulsions may also be spectrally sensitized by the use of various sensitizing dyes.

These silver halide emulsions may be prevented from the occurrence of fog by using known stabilizers such as for example imidazoles, triazoles, azaindenes and the like.

The metallic salt particles of the present invention hereinbefore described, when their surface is not covered by a less-solubilizing agent, are those whose dissolving rate to the hereinafter described dissolving material is larger than that of the foregoing light-sensitive silver halide particles and are of substantially non-light-sensitive metallic salts.

The words "substantially non-light-sensitive" mean "being non-light-sensitive" in the relative relation to the foregoing light-sensitive-silver halide, so that, to be more concrete, it should be understood that the light-sensitive photographic element of the present invention is substantially not sensitive to the light energy level necessary for the foregoing light-sensitive silver halides to be sensitive to. More particularly, the metallic salt particles of the present invention are such minute particles of metallic salts that the metallic salt has a speed at the highest not more than 1/10 of the foregoing light-sensitive silver halides. And the metal ions or metal complex ions resulting from the dissolving of the metallic salt particles are reduced to metal on the physical development nuclei in the presence of a reducing agent.

The metallic salt particles for use in the present invention should be selected from those having such characteristics as has been described above. Particularly in the preferred embodiment of the present invention there should be selected such metallic salt particles as silver halide particles substantially not light-sensitive whose dissolving rate in the material that dissolves silver halide particles is larger than that of the foregoing light-sensitive halide particles. To be more concrete, the metallic salt particles preferably applicable to the present invention are of pure silver bromide or pure silver chloride not chemically sensitized or a mixture of both, whose crystals are desired to be smaller in size than those of the foregoing light-sensitive silver halides. These metallic salt particles may be used within the range of from 0.2 to 10 moles per 1 mole of the light-sensitive silver halide.

The surface of the metallic salt particles used in the present invention are covered with the compound which makes the metallic salt particle less soluble, and it is hereinafter referred to as a less-solubilizing agent. The agent is a compound to prolong the dissolving rate of the particles in such a way that is adsorbed to the surface of the metallic salt particle or to a portion of the surface of the particle which becomes an active site of the dissolving reaction. The less-solubilizing agent also includes such compounds that are adsorbed to the surface of well-soluble metallic salt particles to form less-soluble salts or complex salts with metal ions.

According to a preferred embodiment of the present invention, the less-solubilizing agent is selected from such compounds that are adsorbed to silver halide particles, well-soluble metallic salt particles, to reduce the solubility of said silver halide particles. These compounds include, for example, mercapto compounds such as, e.g., cysteine, 1-phenyl-5-mercaptotetrazole, mercaptobenzthiazole, mercaptobenzselenazole, mercaptobenzoxazole, mercaptobenzimidazole, benzylmercaptan, 4-ethyl-2-thioxazoline, 2-mercapto-6-azauracil, 4-hydroxy-2-mercapto-6-methyl-pyrimidine, 3-mercapto-4-phenyl-5-methyl-1,2,4-triazole, and the like. Besides, thiourea, indazoles, triazoles, imidazoles and the like may also be compounds preferably usable in the present invention.

Further the internally fogged and substantially non-light-sensitive silver halide emulsion applicable to the present invention may be obtained in such a manner that the silver halide is chemically fogged by a fogging agent and with this as nucleus further covered by silver halide. Alternatively, this may also be accomplished, as described in U.S. Pat. No. 2,592,250, by optically fogging; by exposing an internal latent image type emulsion to light.

Such internally fogged silver halides may include silver chloride, silver bromide, silver chlorobromide, silver iodobromide, silver chloroiodobromide or mixtures thereof, but among them silver chloride, silver chlorobromide or silver bromide is suitably used. These internally fogged silver halides may be used within the range of from 0.01 to 100 moles, preferably from 0.1 to 80 moles per 1 mole of the foregoing metallic salt particles.

The silver halide photographic light-sensitive material of the present invention may take various modes depending on purpose or use.

The silver halide photographic light-sensitive material of the present invention may have a support coated thereon with such combined layers as (1) a layer containing light-sensitive silver halide particles, (2) a layer containing non-light-sensitive and less-soluble metallic salt particles of metallic which the metallic salt is itself soluble but the surface thereof is made less soluble by the less-solubilizing agent and (3) a layer containing internally fogged, substantially not light-sensitive silver halide particles, the combined component layers being allowed to take a variety of compositions; for example, such a composition as having a support provided thereon in order from the support a layer containing internally fogged silver halide particles, a layer containing metallic salt particles, and a layer containing light-sensitive silver halide particles, or otherwise these layers may be superposed in reverse order. Alternatively, for example, there is permitted such a two-layer composition that a support is coated thereon in order from the support with a layer containing internally fogged silver halide particles and a single layer combiningly containing both light-sensitive silver halide particles and non-light-sensitive metallic salt particles, and further such a single layer composition that contains a mixture of the light-sensitive silver halide, metallic salt and internally fogged silver halide particles. Furthermore, in other ways, two supports are prepared and combined layers are coated on them respectively; or three supports are prepared each of which may be provided with a respective single layer.

The preferred composition of the silver halide photographic light-sensitive material of the present invention is in the form of a single layer coated on a support containing a mixture of light-sensitive silver halide, metallic salt and internally fogged silver halide particles or of two layers coated on a support; one layer containing a mixture of metallic salt and internally fogged silver halide particles and another containing only light-sensitive silver halide particles, in the order described from the support side.

In addition, in the photographic light-sensitive material of the present invention, there may be applied to the aforesaid internally fogged silver halide particles such conventionally known physical development nuclei, as, e.g., colloids of noble metals such as gold, silver, platinum; sulfides or selenides of heavy metals such as silver, palladium, zinc, cobalt, mercaptan compounds and stannic halides. The mixing ratio of these compounds may be selected arbitrarily.

The above-described compositions of the light-sensitive material of the present invention may be at need provided in an appropriate position thereof with a protective layer or an antihalation layer, and further may contain various photographic additives other than the hereinbefore described photographic additives. The foregoing light-sensitive silver halide particles, metallic salt particles, and internally fogged silver halide particles may be singly or in a mixture of two or more of them dispersed into an appropriate binder. As the binder there may be applied various hydrophilic colloids, most preferably, gelatin.

The preferred hydrophilic colloids usable in the present invention include besides the above gelatin, derivative gelatin, colloidal albumin, agar-agar, gum arabic, alginic acid, a cellulose derivative such as e.g., the cellulose acetate hydrolyzed up to 19–26% acetyl content, polyacrylamide, imidated polyacrylamide, casein, polymers such as vinyl alcohol polymers, polyvinyl alcohols, polyvinyl pyrolidone, hydrolyzed polyvinyl acetates containing urethane carboxylic acid groups or cyanoacetyl groups such as vinyl alcohol-vinyl cyanoacetate copolymers, polymers such as obtained by the polymerization of protein or saturated acylated protein and a monomer having a vinyl radical, and the like.

In the present invention, it is preferred that to improve the physical characteristics of coating layers comprising such aforementioned hydrophilic colloids, various physical characteristics improving agents including, e.g., hardeners are at need added to the layers. For example, the addition of hardeners not only provides multiplied effects for the prevention of the occurrence of abrasions on the photosensitive material but improves the mechanical strength of the layers and the characteristics of antidissolving in a processing solution, thus enabling to obtain a photographic material very excellent in physical characteristics.

In the case of using gelatin as a hydrophilic colloid, typical examples of hardeners therefor are ones belonging to aldehyde, epoxide ethyleneimide, active halogen, vinyl sulfone, isocyanate, sulfonate, carbodiimide, mucochloric acid, acyloyl compounds and the like.

To the hydrophilic colloid for use in the present invention there may be added at need within the range of not harming the effects of the present invention, besides the above hardeners, such photographic additives as, e.g. gelatin plasticizers, surface active agents, ultraviolet absorbing agents, antistain agents, pH control agents, antioxidation agents, antistatic agents, viscosity increasing agents, graininess improving agents, dyes, mordants, brightening agents, developing rate control agents, matting agents and the like.

The support for use in the present invention include, e.g. baryta paper, polyethylene-coated paper, polypropylene synthetic paper, glass plates, cellulose acetate, cellulose nitrate, polyester film such as, e.g., polyethylene terephthalate and the like, polyamide film, polypropylene film, polycarbonate film, polystyrene film and the like, and these supports are arbitrarily selected according to the use of respective photographic light-sensitive materials. And the surface of these supports, for the purpose of improving the adherence thereof to component layers, may be subjected to various hydrophilic treatments such as, e.g., saponification, corona discharging, subbing setting treatments and the like.

The silver halide photographic light-sensitive material of the present invention, after being exposed to light, is treated with a processing solution containing a reducing agent and material for dissolving metallic salt particles.

Developing agents, the reducing agent to be contained in the processing solution of the present invention, include such polyhydroxybenzenes known to those in the art as, e.g., hydroquinone, toluhydroquinone, 2,5-dimethyl hydroquinone; 3-pyrazolidones such as 1-phenyl-3-pyrazolidone, 1-phenyl-4-methyl-3-pyrazolidone; aminophenols such as o-aminophenol, p-aminophenol; 1-aryl-3-aminopyrazolines such as, 1-(p-hydroxyphenyl)-3-aminopyrazolidone, 1-(p-methylaminophenyl)-3-pyrazoline; ascorbic acid, and other compounds such as described as developing agents in Chapter 13 of the 3rd edition of "The Theory of Photographic Process" written by C. E. K. Mees and T. H. James, published by Macmillan Co., N.Y. in 1966, and in P.P. 16–30 of the "Photographic Processing Chemistry" written by L. P. A. Mason, published by The Focal Press, London in 1966. These compounds may be used singly or in combination.

The metallic salt dissolving agent in the processing solution of the present invention should be such a material as to react with metallic salt particles to produce metal ions or soluble metal complex ions and may be the solvent of the processing solution itself; i.e., water. According to the preferred embodiment of the present invention the foregoing dissolving agent should be a material substantially not dissolving light-sensitive silver halide, or a material dissolving silver halide particles different in the solubility from the said light-sensitive silver halide being metallic salt particles in the adding quantity substantially not dissolving light-sensitive silver halide, typical examples of the dissolving agent being sulfites such as sodium sulfite; thiosulfates such as sodium thiosulfate, potassium thiosulfate, ammonium thiosulfate; cyanates such as potassium cyanate, sodium cyanate; thiocyanates such as sodium thiocyanate, ammonium thiocyanate; amino acid compounds such as cystine, cysteine; thiourea compounds such as thiourea, phenyl thiourea; thioether compounds such as 3,6-di-thia-1,8-octadiol.

In the present invention, the processing solution containing a reducing agent and dissolving agent may be either in the form of a pair of separated solutions; one is for the reducing agent while the other for the dissolving agent, or in the form of a single solution containing both agents. These processing solutions may also be used in an increased viscosity by the application of an appropriate viscosity increasing agent. The pH value of such processing solutions should be 5 or more, most suitably from about 5.5 to 13.2.

To the above processing solution(s) following compound may be added when necessary hydroxides or carbonates of alkali metals as alkali agents; weak acid salts and the like as pH buffers; various pyridinium compounds, polythioethers, organic amines and the like as development accelerators; mercaptobenzimidazoles, indazoles as antifoggants; and other additives including alkali bromides, thiosulfonyl compounds, antistain agents, preservatives, surfactants and the like.

The development with such processing solution(s), when a rapid processing is needed, may be made under the condition of 30° to 50° C./10 to 50 seconds, but a development temperature and time are allowed to be selected at need.

On the other hand, fixing agents for silver halide include generally known solvents for silver halide such as water-soluble thiosulfates, e.g., potassium thiosulfate, sodium thiosulfate, ammonium thiosulfate and the like; water-soluble thiocyanates such as, e.g., potassium thiocyanate, sodium thiocyanate, ammonium thiocyanate, and the like; water-soluble organic diols such as 3-thia-1,5-pentanediol, 3,6-dithia-1,8-octanediol, 3,6,9-trithia-1,11-undecanediol, 3,6,9,12-tetrathia-1,14-tetradecanediol and the like; water-soluble sulfur-containing organic dibasic acid such as ethylene-bis-thioglycolic acid and the like, and the water-soluble salts thereof or mixtures of these compounds.

The solution containing one of such fixing agents, if desired, may further contain preservatives such as sulfites, hydrogen sulfites; pH buffers such as boric acid, borates; pH adjusting agents such as acetic acid; hardeners such as glutar aldehyde; chelating agents, and the like.

The following is a prescription of a preferred developing bath:

| | |
|---|---|
| Phenidone | 1.0 g |
| Potassium sulfite, 50% solution | 120 cc |
| Hydroquinone | 25 g |
| Potassium hydroxide | 15 g |
| Boric acid | 10 g |
| Disodium ethylenediamine tetraacetate | 5 g |
| 5-nitro-1H-indazole | 0.1 g |
| Potassium bromide | 0.5 g |
| Glutar aldehyde, 25% solution | 5.0 cc |
| Potassium thiocyanate | 2.0 g |
| Ethylene glycol | 10 cc |
| Water to make 1 liter, pH: 10.5 | |

As a fixer, for example, the SAKURA XF (manufactured by Konishiroku Photo Ind. Co., Ltd.) and the like may be used.

As has been described in detail, the method for the formation of photographic images of the present invention, since the method is such that the silver halide having an internally fogged nucleus is used in place of the physical development nucleus which has been applied to the photosensitive material for forming negative images in the diffusion transfer process, has been able to not only prevent the occurrence of fog and stain which have been the disadvantage of the conventional process but to improve the color tone of the developed silver in less-exposed regions.

The method for the formation of photographic images of the present invention is illustrated in further detail with reference to examples below, but the present invention is not limited thereto.

EXAMPLE 1

Preparation of a Light-Sensitive Silver Halide Emulsion

A silver iodobromide emulsion (containing 7 mol % silver iodide) was prepared by the ordinary neutral method from silver nitrate, potassium bromide and potassium iodide, and the resulting emulsion was chemically sensitized by the gold-sulfur sensitizing method, to which was then added an appropriate quantity of 4-hydroxy-6-methyl-1,3,3a,7-tetrazaindene as a stabilizer, thus obtaining a high-speed silver iodobromide emulsion.

Preparation of a Well-Soluble Metallic Salt Particles

A pure silver chloride emulsion was prepared from silver nitrate and sodium chloride by the ordinary neutral method, and to the resulting emulsion was added 1-phenyl-5-mercaptotetrazole as a less-solubilizing agent in the amount of 0.85 g per mol of silver chloride. The mean particle diameter of the thus obtained emulsion was about 0.1 micron.

Preparation of an Internally Fogged Emulsion (1)

To a 4% aqueous gelatin solution while stirring at 45° C. were added simultaneously both an aqueous silver nitrate solution and an aqueous sodium chloride solution spending a period of 12.5 minutes. To the resulting mixture were added thiourea dioxide, chloroauric acid and ammonium thiocyanate, and ripened for a period of 40 minutes, thereby producing fog nuclei. To the product were further added simultaneously both an aqueous silver nitrate and aqueous sodium chloride solutions spending a period of 12.5 minutes, the product was washed in an ordinary manner of precipitation, and was redispersed into an aqueous gelatin solution, whereby an internally fogged emulsion was obtained.

Control: Preparation of Physical Development Nuclei

An yellow colloidal silver was prepared by reducing silver nitrate with dextrin in an aqueous gelatin solution.

Sample 1.

To the foregoing silver chloride emulsion was added the internally fogged emulsion, and to the mixture was added an appropriate quantity of saponin as a coating aid, and the resulting mixture was coated uniformly over a subbed polyester base. The coated silver quantity of the silver chloride emulsion at this time was 1.4 g/m$^2$, while that of the internally fogged emulsion was 0.6 g/m$^2$. Subsequently, the resulting layer was then coated thereover with the foregoing light-sensitive silver iodobromide emulsion, whose silver quantity was 2.0 g/m$^2$. Further, over this layer was coated an aqueous gelatin solution as a protective layer, thus producing a light-sensitive material of the present invention.

Control 1.

In place of the internally fogged emulsion of Sample 1 the foregoing physical development nuclei was added so that its coated silver quantity was 0.01 g/m$^2$. The coated silver quantity of the silver chloride emulsion at this time was 2.0 g/m$^2$.

Control 2.

A sample excluding the silver chloride emulsion in Sample 1 was prepared. A thus prepared film piece was exposed through a wedge to light of 3.2 C.M.S., and after that it was developed in a processing bath of the following prescription at the temperature of 35° C. for 30 seconds, followed by fixing, washing and drying, and afterward was subjected to a sensitometry test.

| Developing Bath: | |
|---|---|
| Hydroquinone | 25.0 g |
| Potassium sulfite | 60.0 g |
| Phenidone | 1.20 g |
| Boric acid | 10.0 g |
| Disodium ethylenediamine tetraacetate | 5.0 g |
| Potassium hydroxide | 15.0 g |
| Glutar aldehyde | 2.5 g |
| 5-nitro-1H-indazole | 100 mg |
| Potassium bromide | 100 mg |
| 1-phenyl-5-mercaptotetrazole | 15 mg |
| Potassium thiocyanate | 2.0 g |
| Water to make 1 liter | |

Note: An aqueous $H_2SO_4$ or KOH solution is added to the bath so that its pH is adjusted to be 10.3.

The results are shown in Table 1:

TABLE 1

| | Relative speed | Maximum density | Gamma | Fog | Color tone |
|---|---|---|---|---|---|
| Sample 1 | 109 | 2.8 | 3.0 | 0.04 | Black |
| Control 1 | 100 | 2.9 | 2.7 | 0.10 | Brown |
| Control 2 | 80 | 1.4 | 2.0 | 0.02 | Black |

As apparent from the above table, the processing of the photosensitive material of the present invention shows much excellence in the speed, gamma, fog and color tone as compared to that of the physical development nuclei. And such yellow stain in the case of the physical development nuclei does not occur in the photosensitive material of the present invention. Control 2 wherein the internally fogged emulsion only was used in the same quantity as in Sample 1 shows much inferiority in the speed, maximum density and gamma to Sample 1.

EXAMPLE 2

Preparation of an Internally Fogged Emulsion (2)

A silver bromide emulsion was prepared by adding simultaneously both an aqueous silver nitrate and aqueous potassium bromide solutions to an aqueous gelatin solution. To the emulsion were added thiourea dioxide, chloroauric acid and ammonium thiocyanate, and the mixture was subjected to ripening for a period of 50 minutes at the temperature of 45° C. After the further addition of an aqueous silver nitrate solution and an aqueous sodium chloride solution the resulting emulsion was washed in an ordinary way of precipitation, and redispersed into an aqueous gelatin solution, thereby preparing an internally fogged silver chloride emulsion.

Sample 2.

The foregoing internally fogged silver chlorobromide emulsion was added to the foregoing silver chloride emulsion to prepare Sample 2 similar to Sample 1 provided that the coated silver quantity of the silver chloride was 1.0 g/m$^2$, while that of the internally fogged emulsion was 1.0 g/m$^2$.

Control 3.

The light-sensitive silver halide emulsion was coated on a polyester base so that its coated silver quantity was the same as the entire quantity of coated silver (4.0 g/m$^2$) of Sample 2.

These samples were developed in the foregoing developing bath at the temperature of 35° C. for 30 seconds. The results are shown in Table 2, and the characteristics curves are shown in FIG. 1 wherein Curve A is of Sample 2, while Curve B is the developed result of Control 3. Despite of the same coated silver quantity, Curve A shows higher Maximum density, higher speed, and higher contrast than those of Curve B, so that the results show how excellent the method of the present invention is.

TABLE 2

| | Relative speed | Maximum density | Gamma | Fog |
|---|---|---|---|---|
| Sample 2 | 190 | 3.0 | 3.0 | 0.04 |
| Control 3 | 100 | 1.5 | 1.6 | 0.03 |

Figure 1:
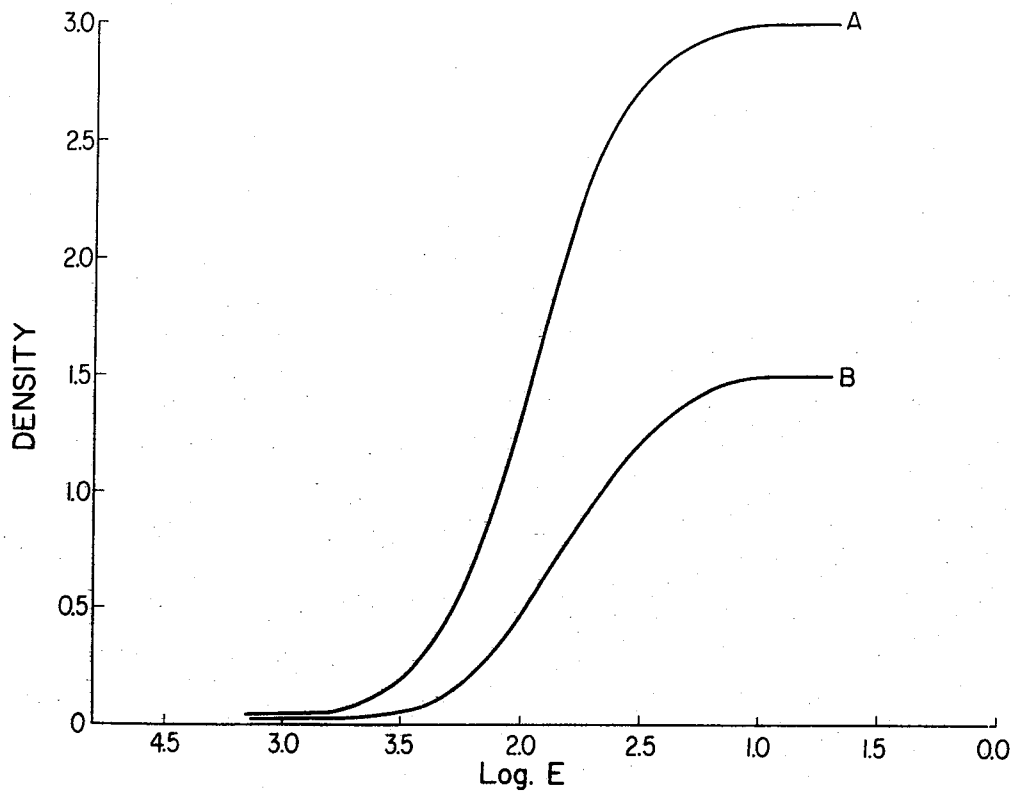
FIG. 1 shows the sensitometric results in the form of characteristics curves of the sample in accordance with the method of the present invention and of the control in Example 2.

What is claimed is:

1. A method for the formation of a negative photographic image comprising
   (a) imagewise exposing a silver halide photographic light sensitive material and
   (b) developing said material with a processing solution containing at least a developing agent for silver halide and an agent for dissolving metallic salt particles in which said photographic material has a support and at least one layer coated on one side having
   (a) light sensitive silver halide particles,
   (b) metallic salt particles which are substantially non-light sensitive and which are soluble in said processing solution, said metallic salt particles having been modified on the surface thereof with metallic salt solubility reducing agent, such that in its presence the solubility of the metallic salt at its surface is reduced below the metallic salt solubility in the absence of said solubility reducing agent and
   (c) internally fogged silver halide particles which are substantially non-light sensitive, and wherein said metallic salt particles are silver halide.

2. A method according to claim 1, wherein the light-sensitive silver halide is silver iodobromide.

3. A method according to claim 2, wherein the silver iodobromide contain 50 mole % or less silver iodide.

4. A method according to claim 1, wherein the amount of the substantially non-light-sensitive metallic salt used is in the range of 0.2 to 10 moles per 1 mole of the light-sensitive silver halide.

5. A method according to claim 1, wherein the internally fogged and substantially non-light-sensitive silver halide is silver chloride, silver chlorobromide or silver bromide.

6. A method according to claim 1, wherein the amount of the internally fogged and substantially non-light-sensitive silver halide is in the range of 0.01 to 100 moles per 1 mole of the metallic salt particles.

7. A silver halide photographic material comprising a support and at least one layer coated thereon having
   (a) light-sensitive silver halide particles,
   (b) silver halide particles which are substantially non-light sensitive and which are soluble in a processing solution, said silver halide particles having been modified on the surface thereof with a silver halide solubility reducing agent, such that, in the presence of said agent, the solubility of the silver haldide at its surface is reduced below the silver halide solubility in the absence of said solubility reducing agent, and
   (c) internally fogged silver halide particles which are substantially non-light sensitive.

8. A silver halide photographic material according to claim 7, wherein said material comprises a support, a first layer which contains a mixture of said metallic salt particles and said internally fogged silver halide particles which are substantially non-light-sensitive and a second layer which contains said light-sensitive silver halide particle in this order from the support.

9. A silver halide photographic material according to claim 7, wherein said photographic material comprises a layer having said light-sensitive silver halide particles, said non-light-sensitive metallic salt particles and said internally fogged and substantially non-light-sensitive silver halide particles.

10. A method for the formation of a negative photographic image comprising
   (a) imagewise exposing a silver halide photographic light sensitive material and
   (b) developing said material with a processing solution containing at least a developing agent for silver halide and an agent for dissolving metallic salt particles in which said photographic material has a support and at least one layer coated on one side having
   (a) light sensitive silver halide particles, (b) metallic salt particles which are substantially non-light sensitive and which are soluble in said processing solution, said metallic salt particles having been modified on the surface thereof with metallic salt solubility reducing agent, such that in its presence the solubility of the metallic salt at its surface is reduced below the metallic salt solubility in the absence of said solubility reducing agent and (c) internally fogged silver halide particles which are substantially non-light sensitive, and wherein said metallic salt particles are silver bromide or silver chloride particles which are not chemically sensitized.

* * * * *